US012365374B2

(12) United States Patent
Staab et al.

(10) Patent No.: US 12,365,374 B2
(45) Date of Patent: Jul. 22, 2025

(54) UNMANNED RAIL VEHICLE AND METHOD OF DETERMINING ITS POSITION

(71) Applicant: ABB Schweiz AG, Baden (CH)

(72) Inventors: Harald Staab, Neckargemünd (DE); Daniel Lasko, East Granby, CT (US); Will Eakins, Coventry, CT (US); Harshang Shah, Glen Allen, VA (US)

(73) Assignee: ABB Schweiz AG, Baden (CH)

( * ) Notice: Subject to any disclaimer, the term of this patent is extended or adjusted under 35 U.S.C. 154(b) by 455 days.

(21) Appl. No.: 17/597,049

(22) PCT Filed: Jun. 12, 2020

(86) PCT No.: PCT/US2020/037416
§ 371 (c)(1),
(2) Date: Dec. 23, 2021

(87) PCT Pub. No.: WO2020/263598
PCT Pub. Date: Dec. 30, 2020

(65) Prior Publication Data

US 2022/0266882 A1 Aug. 25, 2022

(51) Int. Cl.
*B61L 25/02* (2006.01)
*B61L 23/04* (2006.01)

(52) U.S. Cl.
CPC ..... *B61L 25/025* (2013.01); *B61L 23/041* (2013.01); *B61L 25/021* (2013.01); *B61L 25/026* (2013.01); *B61L 2210/02* (2013.01)

(58) Field of Classification Search
CPC .... B61L 25/025; B61L 23/041; B61L 25/021; B61L 25/026; B61L 2210/02; B61L 15/0063; B61L 23/04
See application file for complete search history.

(56) References Cited

U.S. PATENT DOCUMENTS

2013/0317676 A1* 11/2013 Cooper ..... B61L 23/044 701/19
2014/0142868 A1* 5/2014 Bidaud ..... G01N 21/8803 702/34

(Continued)

FOREIGN PATENT DOCUMENTS

CL 2019001563 A1 12/2019
DE 3611125 A1 10/1987

(Continued)

OTHER PUBLICATIONS

Chilean Office Action; Application No. 202103496; Issued: May 2, 2023; 3 Pages.

(Continued)

*Primary Examiner* — Mary Cheung
(74) *Attorney, Agent, or Firm* — Whitmyer IP Group LLC

(57) ABSTRACT

An unmanned rail vehicle for surveillance, inspection and/or maintenance of an infrastructure, the infrastructure including a rail structure with a rail, the unmanned rail vehicle being movable along the rail and the unmanned rail vehicle including a first position sensor system configured for measuring, by interaction with the rail structure, first position data indicative of a position of the unmanned rail vehicle along the rail, a second position sensor system configured for measuring, by interaction with the rail structure, second position data indicative of a position of the unmanned rail vehicle along the rail, a position determining unit configured for receiving and combining first and second position data to determine the position of the unmanned rail vehicle along the rail.

22 Claims, 5 Drawing Sheets

(56) References Cited

U.S. PATENT DOCUMENTS

| | | | | |
|---|---|---|---|---|
| 2018/0339720 | A1 | 11/2018 | Singh | |
| 2019/0232988 | A1* | 8/2019 | Lang | B61L 25/025 |

FOREIGN PATENT DOCUMENTS

| | | | | |
|---|---|---|---|---|
| DE | 20200942 | U1 | | 7/2002 |
| DE | 102007028325 | A1 | | 12/2008 |
| DE | 102015203476 | A1 | | 9/2016 |
| JP | 2018059770 | A | * | 4/2018 |
| WO | 2015043974 | A1 | | 4/2015 |
| WO | 2018104504 | A1 | | 6/2018 |
| WO | 2020263598 | A1 | | 12/2020 |

OTHER PUBLICATIONS

PCT International Search Report and Written Opinion of the International Searching Authority: Completed: Sep. 24, 2020; Mailing Date: Oct. 2, 2020, 17 Pages.

* cited by examiner

UNMANNED RAIL VEHICLE AND METHOD OF DETERMINING ITS POSITION

TECHNICAL FIELD

An aspect of the present invention relates to an unmanned rail vehicle for surveillance, inspection and/or maintenance of an infrastructure. According to an aspect, the unmanned rail vehicle has a first position sensor system, a second position sensor system, and a position determining unit for carrying out the surveillance, inspection and/or maintenance of the infrastructure. An aspect of the present invention also relates to an infrastructure including the unmanned rail vehicle and a rail structure with a rail.

BACKGROUND

There is a general need to do regular inspection of infrastructures such a roads, railways, pipelines, tunnels, seaports, airports, parks, sports facilities, racetracks, petrochemical plants, mines, electric switchyards, solar power plants, wind power plants, ocean vessels, factories, and warehouses for various purposes, such as security, equipment monitoring, and maintenance. It is common practice in many cases that regular inspection tours or patrols are carried out by personnel. However, it would sometimes be beneficial to automate such regular activities without the need to send personnel. Possible advantages of automation include not exposing personnel to on-site hazards, costs savings, and/or better consistency in the quality of inspection results. For this purpose, a rail-based vehicle is, for example, described in WO 2018/104504 A1.

An apparatus for monitoring a conveyor belt installation is, for example, described in DE 3611125 A1. The apparatus is unmanned and is guided on or adjacent to a conveyor belt supporting frame of the belt installation. Thereby, the apparatus can be moved over the length of the conveyor belt. The apparatus has a camera system and other sensors. Thereby it becomes possible to determine damage to the conveyor belt installation.

There are different ways to measure and control the position of an unmanned vehicle on a rail or a linear guide. However, in harsh outdoor environments both, the sensory equipment and the method of position measurement have to be especially rugged and reliable. This, however, results in costly, bulky, and complex systems.

In harsh outdoor environments, the sensory equipment of the apparatuses is prone to detection errors leading to undesirable positioning errors of the unmanned devices. Hence, there is a need for methods and devices to reliably measure and control the position of an unmanned rail vehicle in harsh environments.

SUMMARY

Aspects of the present invention aim to reduce some of the above-mentioned drawbacks at least partially.

According to an aspect of the invention, an unmanned rail vehicle for surveillance, inspection and/or maintenance of an infrastructure, an infrastructure, and a method are provided.

In the following, some preferred aspects of the invention are described. It is understood that each aspect can be combined with any other aspect or individual feature of an embodiment described herein.

The infrastructure may be located separated from inhabitable land, be dangerous or difficult to access by humans.

Examples of an infrastructure include transportation infrastructure, such a roads, railways, subways, tunnels, sea ports, ocean vessels, air ports; industrial facilities, such as pipelines, petrochemical plants, mines (and in particular a conveyor system for a mine), electric switchyards, solar power plants, wind power plants factories, warehouses; and large outdoor environments, such as parks, sports facilities, race tracks, farms, forests, etc.

The unmanned rail vehicle includes a first position sensor system, and a second position sensor system.

The first and the second position sensor systems may be both individually configured for measuring first and second position data, respectively, indicative of a position of the unmanned rail vehicle along a rail. Both, first and second position sensor systems may be adapted for respectively measuring position data indicative of a position of the unmanned rail vehicle along the rail by interaction with a rail structure comprising the rail.

Preferably, at least one of the first position sensor system and the second position sensor system is a marker-detecting position sensor system, i.e., is configured for collecting position data based on interaction with at least one preassigned reference marker along the rail structure. Alternatively, or additionally, at least one of the first position sensor system and the second position sensor system may be is a progression-detecting position sensor system, i.e., is configured for collecting position data based on detecting a progression of the unmanned rail vehicle along the rail structure. A position sensor system can also be both a marker-detecting position sensor system and a progression-detecting position sensor system.

For example, the position sensor system being a marker-detecting position sensor system may comprise a proximity sensor or switch for interacting with the marker. This allows the position sensor system to collect proximity data with respect to a surface of the rail. If the preassigned reference marker is, for example, a predefined shape feature of the rail such as a hole or a cut-out in the surface of the rail, the position sensor system can collect position data based on a change of the proximity data at the position of the shape feature. Alternatively, the preassigned reference marker may be an inductive marker, an optical marker, an ultrasonic marker, or a combination thereof.

As a further example, the position sensor system being a progression-detecting position sensor system may, for example, comprise a rotational encoder associated with an encoder wheel. The encoder wheel can be configured to roll along the rail structure. The rotational encoder is configured to detect one or more of wheel speed, rotary position, or a combination thereof.

Generally, a progression-detecting position sensor system may be extremely rugged (for example made of rubber), compact, and precise (for example 10 to 1000 counts per mm) to eliminate damage and to ensure correct position data acquisition for the unmanned rail vehicle on the rail or a linear guide even in in harsh, outdoor environments.

Further, such a progression-detecting position sensor system may be arranged in the unmanned rail vehicle to create a well-defined dynamic contact force between each position sensor system and the rail. For example, a position sensor system configured for collecting position data based on detecting a progression of the unmanned rail vehicle along the rail structure may comprise at least one rotational encoder. Preferably, the rotational encoder comprises an encoder wheel dynamically pressed on the rail structure to ensure rolling contact without slip, even in the presence of gaps, dents, surface roughness on the rail.

By using two or more of the position sensor systems the components in each position sensor system can have lower ratings and therefore be cheaper. Yet the performance, accuracy, and reliability of the combination of two or more position sensor systems including a position determining unit for combining the outputs of the position sensor systems is generally improved relative to the performance of a single position sensor system.

For example, the use of two or more of the progression-detecting position sensor systems allows to compensate for errors of individual position sensor systems (for example due to temporary slip of measuring wheels of individual position sensor systems).

Additionally, two or more of the progression-detecting position sensor systems allow to do self-diagnosis of the measurement by combining the position data from individual position sensor systems (for example by cross-comparing the position data for plausibility). If, for example, the position data measured by one rotational encoder drags significantly behind another, then the respective encoder wheel comprised by the rotational encoder may be diagnosed as slipping, and may therefore may be diagnosed to be less reliable. Thus, by using two or more of the position sensor systems, the position measurement can also achieve a high safety performance level for safety-critical applications.

The unmanned rail vehicle further includes a position determining unit.

The position determining unit may be configured for receiving first and second position data collected from the first and the second position sensor system, respectively. Further, the position determining unit may be adapted to combine first and second position data to determine the position of the unmanned rail vehicle along the rail.

For example, the position determining unit may be configured to combine the received position data by i) setting the position data of the unmanned rail vehicle to a known position detected by at least one of the first or second position sensor system being a marker-detecting position sensor system, and ii) computing one or more intermediate position of the unmanned rail vehicle on the rail structure based on, e.g., the last known position as described above, and on one or more progression data inputs received from at least the first or second position sensor system being a progression-detecting position sensor system. Preferably, if a known position of the one or more preassigned reference marker is detected at a computed intermediate position of the unmanned rail vehicle, the position data of the unmanned rail vehicle is set to the position of the one or more preassigned reference markers (e.g., the preassigned reference marker determined to be closest from the computed intermediate position). Thereby, the system is capable of compensating for drift errors of position data acquisition based on one or more progression data inputs.

Moreover, the position measurement can achieve an even higher safety performance level by including two or more position determining units in the unmanned rail vehicle. The two or more position determining units may be configured to in parallel receive the same position sensor system inputs and may be configured to combine the position data received in an analogous way. This allows, in case of a discrepancy of the output values between the two or more position determining units, diagnosis of a malfunction in one of the position determining units and thus increases safety and reliability of the position measurement.

In a particular aspect, the rail vehicle has at least two progression-detecting position sensor systems (e.g., the first and second position sensor systems), and the position determining unit is configured to receive more than one position data inputs from both progression-detecting position sensor systems. Then, in case of a large disparity between the more than one position data inputs (e.g. if the difference exceeds a predetermined threshold), the maximum absolute progression value is selected. This ensures that, if, for example, the position data measured by one rotational encoder drags significantly behind another (i.e. measures a significantly lower value of progression of the unmanned rail vehicle along the rail structure), then the respective encoder wheel comprised by the rotational encoder may be diagnosed to keep slipping because of higher rotational friction due to ingress of dirt into the roller bearings or the like. In such a case, the respective position data input of the rotational encoder can be dismissed to achieve accurate positioning of the unmanned rail vehicle.

Thus, aspects of the invention enable accurately measuring and controlling the position of an unmanned rail vehicle travelling on a rail stably and in a space- and cost-saving manner. The rail vehicle may carry devices for surveillance, inspection, and/or maintenance of the given infrastructure, such as an industrial site.

Herein, unless stated otherwise, all quantities depending on the orientation of the rail assume that the rail vehicle is placed on a horizontal rail, unless stated otherwise. Preferably, the quantities are also valid for any rail having any slope of less than 15°, preferably for any rail having any slope of less than 30° with respect to the horizontal.

BRIEF DESCRIPTION OF THE DRAWINGS

The details will be described in the following with reference to the figures, wherein.

DETAILED DESCRIPTION

Reference will now be made in detail to the various embodiments, which are illustrated in the figures. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to the same or to similar components. Generally, only the differences with respect to the individual embodiments are described. Unless specified otherwise, the description of a part or aspect in one embodiment applies to a corresponding part or aspect in another embodiment as well.

Figure 1:
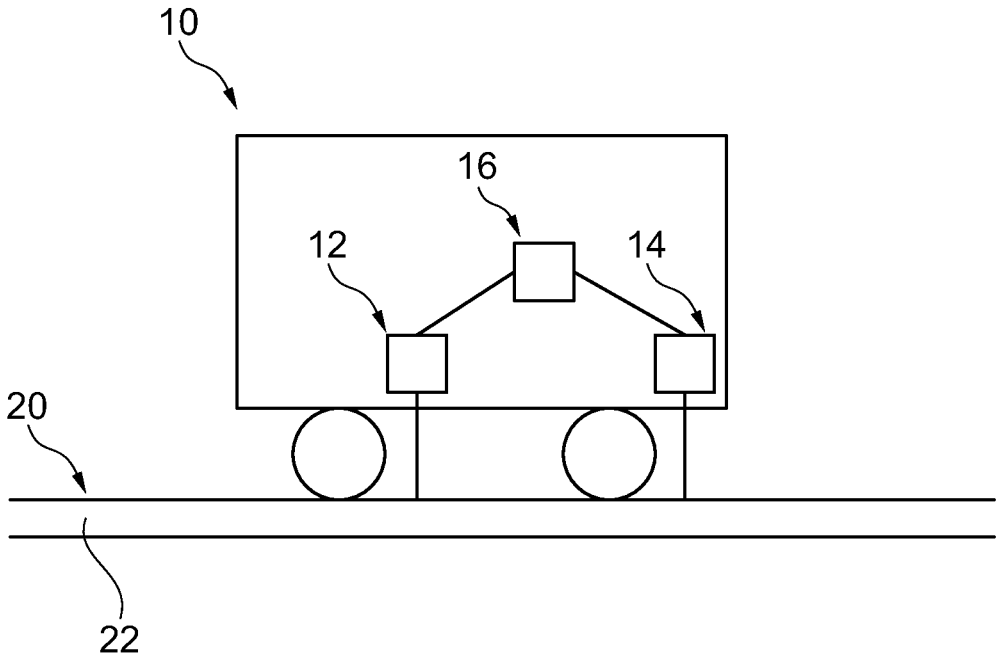
FIG. 1 is a side view of an unmanned rail vehicle according to an embodiment of the invention.

In FIG. 1, an unmanned rail vehicle 10 according to the invention is shown. FIG. 1 shows a side view of the rail vehicle 10 on a rail structure 20.

The rail structure 20 comprises a rail 22. The unmanned rail vehicle 10 is movable along the rail 22. The unmanned rail vehicle 10 has a first position sensor system 12 and a second position sensor system 14. Both, the first position sensor system 12 and a second position sensor system 14 are configured for interaction with the rail structure 20 and for measuring first and second position data indicative of a position of the unmanned rail vehicle 10 along the rail 22, respectively. For example, the first position sensor system 12 and the second position sensor system 14 may be configured for measuring a distance to the surface of the rail structure.

Further, the unmanned rail vehicle 10 has a position determining unit 16. The position determining unit 16 is in contact with the first position sensor system 12 and the second position sensor system 14. For example, the position determining unit 16 is configured for receiving first and second position data measured by the first and second position sensor system, respectively. Further, the position determining unit 16 is configured for combining first and second position data to determine the position of the unmanned rail vehicle 10 along the rail 22, in any manner described herein.

Figure 2:
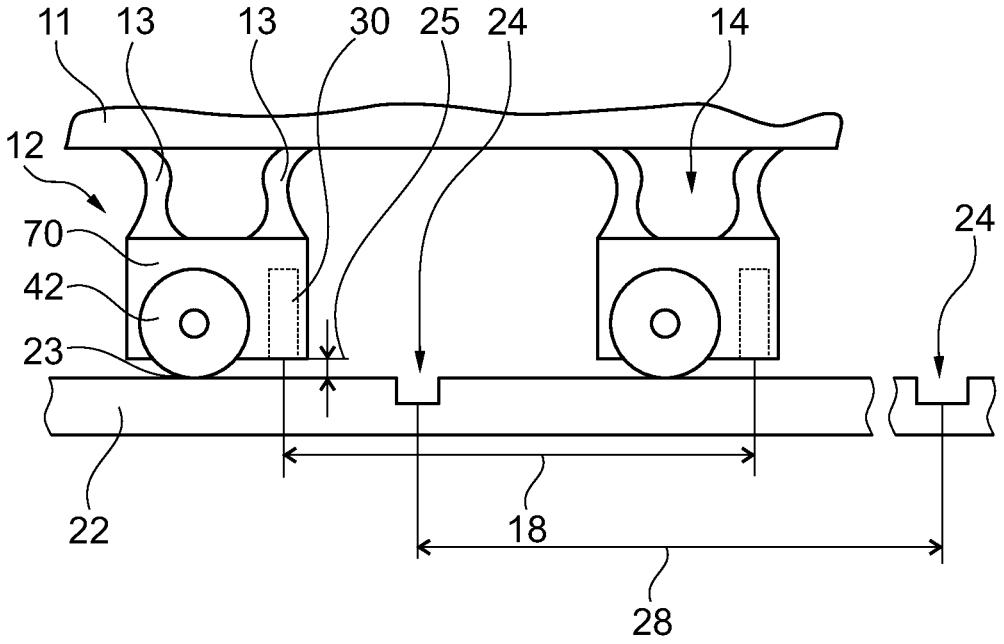
FIG. 2 is a side view of an unmanned rail vehicle according to an embodiment of the invention.
Figure 3:
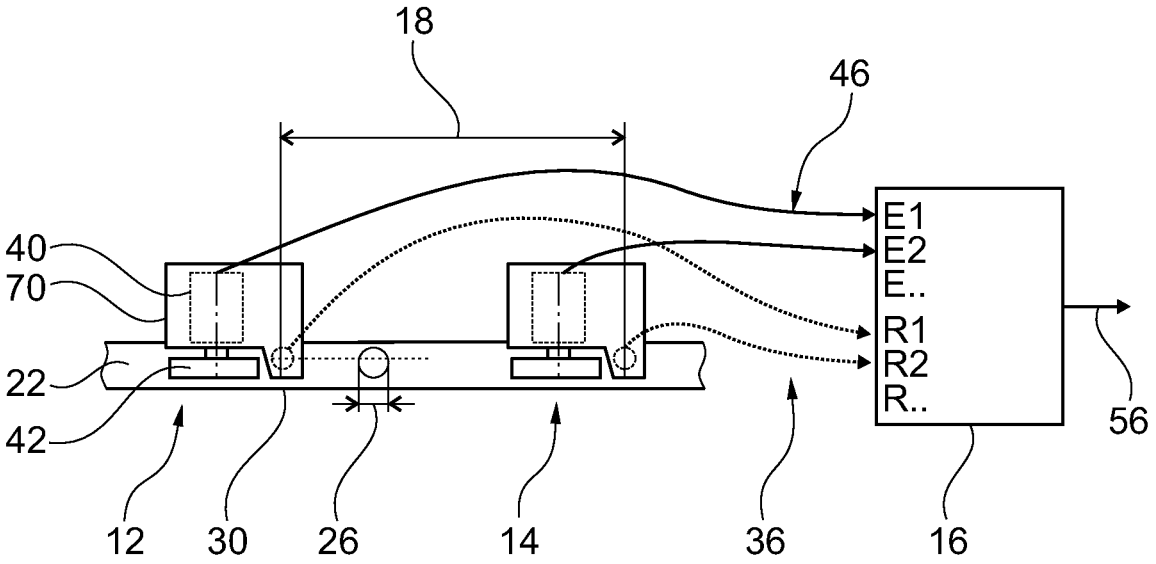
FIG. 3 is a top view of an unmanned rail vehicle according to an embodiment of the invention.

In FIGS. 2 and 3, an unmanned rail vehicle 10 according to a further embodiment of the invention is shown. FIG. 2 shows a side view and FIG. 3 shows a top view of the rail vehicle 10 on a rail 22.

The unmanned rail vehicle 10 has rigid structural parts 11 and is movable along the rail 22. The distance and orientation between the generally smooth surface of the rail 22 and the structural parts 11 stays within narrow tolerances.

The unmanned rail vehicle 10 comprises a first position sensor system 12 and a second position sensor system 14. Each of the position sensor systems 12, 14 comprises a rotational encoder 40 associated with an encoder wheel 42, and a proximity sensor or switch 30. Alternatively, any of the position sensor systems 12, 14 may comprise only one of the rotational encoder 40 and the proximity sensor or switch 30.

Each of the encoder wheel(s) 42 is in rolling contact 23 with the generally smooth surface of the rail 22 and thereby allows measuring, by interaction with the rail structure 20 respective position data indicative of a position of the unmanned rail vehicle 10 along the rail 22. Specifically, by encoding the rotational angle or velocity of the encoder wheel rolling along the rail 22, the rotational encoder collects the position data based on detecting the progression of the unmanned rail vehicle along the rail structure 20.

The proximity sensor(s) or switch(es) 30 is mounted on the unmanned rail vehicle 10 in a defined and known mounting distance 18 along a longitudinal axis of the unmanned rail vehicle 10 (i.e. in moving direction of the unmanned rail vehicle 10 on the rail 22).

Further, the unmanned rail vehicle 10 comprises rugged enclosures 70 which positions the encoder wheels 42 and the proximity sensors 30 at a fixed relative distance and orientation such that the proximity sensor 30 keeps an essentially constant distance 25 to the rail surface. The unmanned rail vehicle 10 has flexible mounts 13 between each enclosure 70 and the vehicle structure 11 such that the encoder wheels 42 roll strictly in parallel on the rail and are dynamically pressed on the rail with constant normal force despite of small relative motion between the vehicle structure 11 and the rail 22. Preferably, the enclosures 70 and the flexible mounts 13 are made out of the same rubber-like material. Even more preferably, the enclosure 70 and the flexible mounts 13 are made out of one part, to enhanced protection of the rotational encoder 40 and the proximity sensor 30 (i.e. including cable connections) from shock, mechanical abuse, and ingress of water, dust, or gas.

The rail 22 comprises preassigned reference markers 24, such as holes or cut-outs, at known preassigned rail positions, interspaced by a defined, preassigned spaces 28 between the preassigned reference markers 24. The proximity sensors 30 are able to distinguish the preassigned reference markers 24 from the generally smooth surface of the rail, despite an offset 26 between the beginning and the end (i.e. the physical width) of the preassigned reference marker 24.

Further, the unmanned rail vehicle 10 comprises a position determining unit 16. The position determining unit is configured to receive progression data inputs 46 from each rotational encoder (E1, E2, . . . ) and signals 36 from each proximity sensor (R1, R2, . . . ). Also, the position determining unit is configured to compute output signals 56 which influence the traction and motion of the vehicle along the rail 22.

As an example, a specific purpose of the unmanned rail vehicle according to an embodiment of the invention is the use of a small robotic unmanned rail vehicle for automatic inspection in harsh outdoor environments. For example, the unmanned rail vehicle may be used for the unmanned inspection of conveyors in mining environments. Such conveyors can have many kilometers of length requiring a similar extension of the rail structure 20.

To perform such an automatic inspection the unmanned rail vehicle 10 can be further equipped with sensors for inspection, preferably with at least one of the following: microphone, thermal camera, visual camera, moisture sensor, thermal sensor, wind sensor.

For positioning itself on the rail structure, the unmanned rail vehicle 10 can further feature a sensor system (e.g. a computer vision system, ultrasonic distance sensors, optical/laser distance sensors, radar sensors) that detects regular mechanical features or preassigned markers along the conveyor installation which allow the vehicle to position itself relative to the conveyor.

Furthermore, for automatically performing inspection tours the unmanned rail vehicle 10 includes a motion program which defines the motion of the vehicle. The program has instructions to control positioning of the vehicles' inspection sensors along the rail structure 20.

The above is just one example, and the invention is not limited to a particular infrastructure or industrial site. The infrastructure in which the unmanned rail vehicle may be used for automatic inspection includes roads, railways, subways, pipelines, tunnels, seaports, airports, industrial plants, mines, farms, forests, parks, sports facilities, racetracks etc.

Depending on the functionality of the unmanned rail vehicle (e.g., surveillance, inspection, and/or maintenance operations, such as the inspection of rollers of conveyors), one vehicle may have multiple functionalities, or for each functionality a separate vehicle may be provided. Thus, there may be used a plurality of unmanned rail vehicles in a certain infrastructure. The multiple vehicles may be driven independently from each other for moving separately along the rail. Alternatively, the multiple vehicles may be coupled to each other for moving jointly along the rail.

In the example application of the unmanned rail vehicle for inspecting conveyors, there may be provided at least one of the following functionalities: Inspection of rollers of the conveyors, tagging of rollers, e.g., with a shot of marking paint, inspection of conveyor belt alignment, measurement of environmental conditions (air temperature, wind, dust concentration, gas concentrations, rain amount, radiation, etc.). These functionalities may be provided in a single vehicle or (overlapping or non-overlapping) groups of functionalities may be provided in separate respective vehicles. For example, one rail vehicle may be equipped for inspecting rollers, another rail vehicle may be equipped for tagging rollers, and yet another rail vehicle may be equipped for cleaning the rail.

In another example, one rail vehicle may be a fast inspection vehicle that runs continuously and is equipped for recording data from the surrounding of the rail structure while passing by, and another inspection vehicle equipped with more advanced inspection capabilities may be configured for stopping at a certain position (e.g., at a roller that was found to show signs of degradation by the fast inspection vehicle) and for inspecting the surrounding at this position thoroughly.

Figure 4:
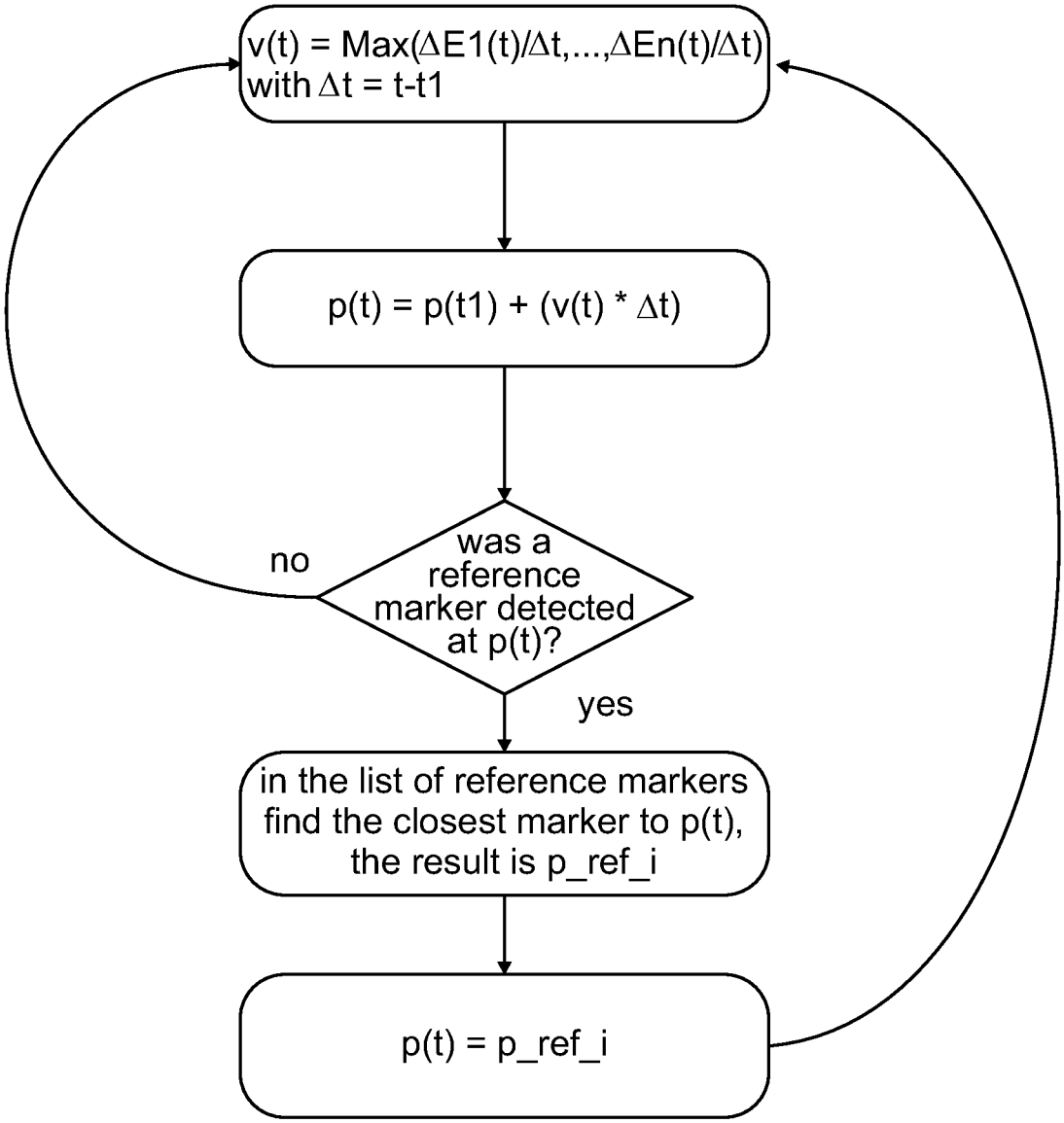
FIG. 4 is a flow diagram illustrating a method according to an embodiment of the invention.

In FIG. 4, a method for computing the position of an unmanned rail vehicle on a rail according to the invention is shown. FIG. 4 shows a flow diagram illustrating the following computations 1. In a first step (box 1), the progression or actual speed v of unmanned rail vehicle 10 on a rail 22 is calculated periodically at every timestep t as v(t).

$$v(t)=\mathrm{Max}(\Delta E1(t)/\Delta t, \ldots, \Delta En(t)/\Delta t) \quad (1)$$

In formula (1), Δt=t-t1, is the time that passed between now (t) and the previous calculation (t1). By taking the maximum value of the progression data inputs (E1, E2, . . . , En) received from the rotational encoder, this method compensates for possible slippage of individual encoder wheels. Preferably, additional filter algorithms are be applied to these signal variables.

2. In a second step (box 2), the position of unmanned rail vehicle 10 on the rail 22 is calculated periodically as p(t).

$$p(t)=p(t1)+(v(t)*\Delta t) \quad (2)$$

Preferably, additional filter algorithms are be applied to these signal variables.

Also, the positions of preassigned reference markers 24 along the rail 22 are identified and stored in a list (p_ref_1, p_ref_2, . . . ) which is accessible by position determining unit 16.

3. In a third step (box 3), a decision is to be made. If a preassigned reference marker 24 is identified at computed position p(t), then the closest position p_ref_i is assumed to be the actual position of the unmanned rail vehicle 10 (box 4) and p(t) is set to p_ref_i (box 5). If not, the method reiterates the first step. With this method an error which might have accumulated by periodically measuring the progression of the unmanned rail vehicle on the rail can be cancelled out.

Figure 5:
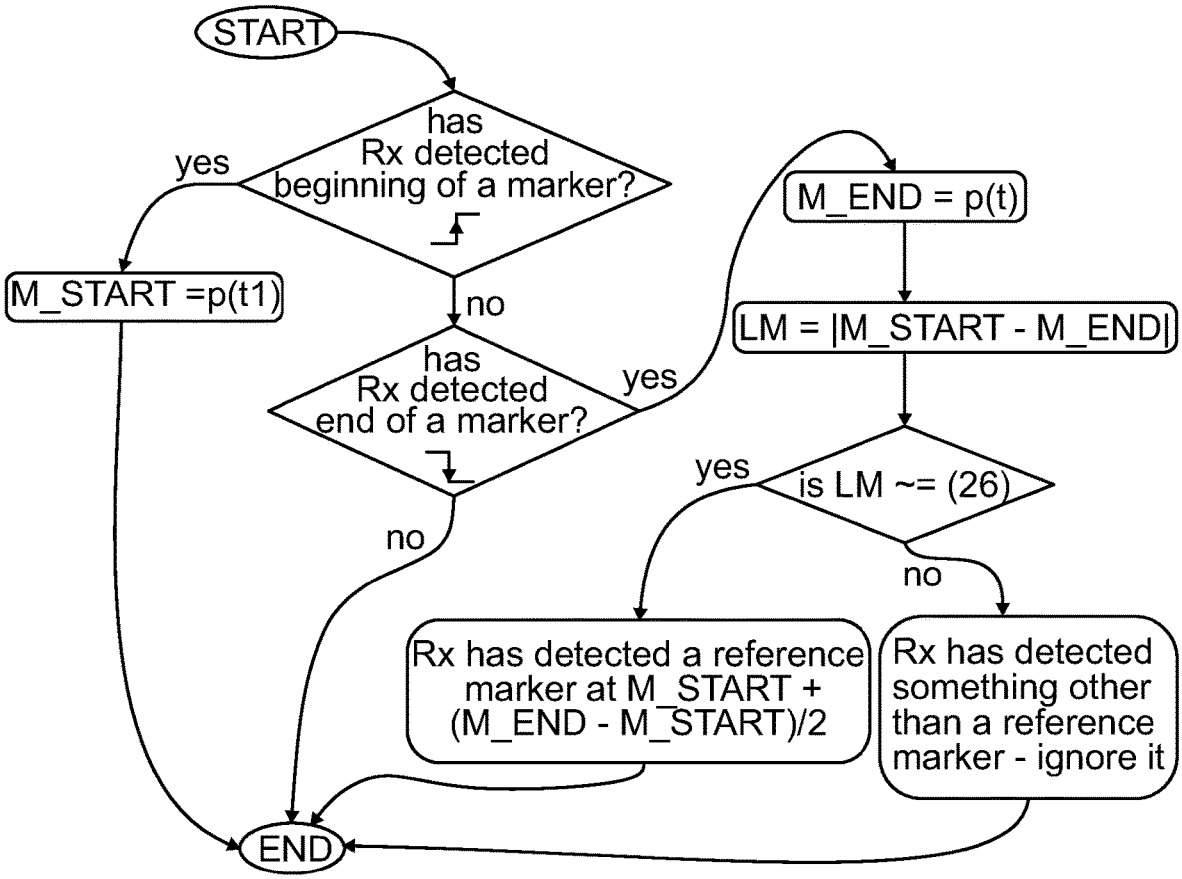
FIG. 5 is a flow diagram illustrating a method according to an embodiment of the invention.

In FIG. 5, a method for identifying preassigned reference markers along a rail according to the invention is shown. FIG. 5 shows a flow diagram illustrating the following computations 1. In a first step (START), a decision is to be made. If a proximity sensor or switch 30 detects a signal change based on interaction with the beginning of a preassigned reference marker 24 (such as by detecting a significantly greater distance between the proximity sensor or switch 30 and the surface of the rail 22 in a consecutive measurement of R1, R2, . . . , Rx), the position p(t1) is registered as "M_START". If not, the method proceeds with a second step.

2. In a second step, another decision is to be made. If a proximity sensor or switch 30 detects a signal change based on interaction with the end of a preassigned reference marker 24 (such as by detecting a significantly smaller distance between the proximity sensor or switch 30 and the surface of the rail 22 in a consecutive measurement of R1, R2, . . . , Rx), the position p(t) is registered as "M_END". If not, the method reiterates the first step.

3. Having registered "M_START" and "M_END", in a third step, travel distance LM is calculated $$LM=|M_\mathrm{START}-M_\mathrm{END}|=p(t)-p(t1)=v(t)*\Delta t \quad (3)$$

4. In a fourth step, it is decided whether a preassigned reference marker has been identified. If the calculated travel distance LM is about the same distance as a respective known physical width 26 of the preassigned reference marker 24 (i.e. the physical extension between the beginning and the end of the marker along the rail), it is concluded that the proximity sensor or switch 30 has detected a preassigned reference marker 24 and its position on the rail is determined, e.g. p_ref is set to be the center of the physical extension of the preassigned reference marker 24

$$p_\mathrm{ref}=M_\mathrm{START}+(M_\mathrm{END}-M_\mathrm{START})/2 \quad (4)$$

If the calculated travel distance LM is significantly smaller or larger than the known physical width 26 of the preassigned reference marker 24, it is concluded that no preassigned reference marker has been identified and the method reiterates the first step.

GENERAL ASPECTS OF THE INVENTION

In the following, further aspects of the invention are described. Each aspect can be combined with any other aspect or part of embodiment described herein. In the description of these aspects, the reference numbers of the above-described embodiments are used for corresponding parts. This is not meant as a limitation; instead, these aspects can be used also independently of these embodiments.

The unmanned rail vehicle 10 may have at least some of the following parts and properties:

- The unmanned rail vehicle 10 has a first position sensor system 12 and a second position sensor system 14. Thus, the unmanned rail vehicle 10 has two or more position sensor systems.
- The unmanned rail vehicle 10 has a position determining unit 16 coupled to the two or more position sensor systems.
- The unmanned rail vehicle 10 is in rolling contact 23 with a rail 22 of a rail structure 20. Thus, the unmanned rail vehicle 10 has two or more wheels providing a rolling contact with the surface of the rail 22.
- The unmanned rail vehicle 10 has one or more rugged enclosures 70 covering a position sensor system.
- The unmanned rail vehicle 10 has flexible mounts 13 between each enclosure 70 and rigid structural parts 11 forming the structure of the vehicle. Due to this construction, the position sensor system is hold strictly in parallel on the rail 22 and the wheels of the unmanned rail vehicle 10 are dynamically pressed on the rail with constant normal force. Preferably, the enclosures 70 and the flexible mounts 13 are made out of the same rubber-like material. Even more preferably, the enclosure 70 and the flexible mounts 13 are made out of one part.
- The unmanned rail vehicle 10 has a functional module for carrying out the surveillance, inspection, and/or maintenance of an infrastructure. The functional module may include process equipment such as an inspection camera, a sensor, a manipulator, or the like. The functional module may have at least one of a computer vision system, an ultrasonic distance sensor, an optical distance sensor, a laser distance sensor, and a radar sensor. Further, the functional module may include a rail inspection system, a vehicle inspection system, an industrial equipment inspection system, a rail cleanup system (e.g., for removal of snow, debris, or other disturbances from the rail 22), a tagging system). Also, multiple unmanned rail vehicles may be provided in an unmanned rail vehicle system, with at least two vehicles having a different set of functionalities.

The unmanned rail vehicle 10 is self-propelled.

The unmanned rail vehicle 10 has a traction system including one or more traction motors. Preferably, the unmanned rail vehicle 10 has a traction wheel actuated by an electric traction motor.

The rail vehicle is a train-like vehicle system with at least one self-propelled traction vehicle.

The unmanned rail vehicle 10 has a rechargeable power source operatively connected to the position sensor systems 12, 14, the position determining unit 16, the traction system, and/or the functional module.

The unmanned rail vehicle 10 has a terminal connectable to an external port. The terminal may be connected to the rechargeable power source for recharging the rechargeable power source by electrical power supplied from the external port, and/or be connected to the position determining unit 16 of the unmanned rail vehicle for allowing data exchange between the position determining unit 16 and an external data port.

The unmanned rail vehicle 10 has a network interface adapted for transferring data to a control center (e.g., a local computer or remote computer, possibly a cloud-based computer system), e.g., for further processing of the data and/or for cloud access to the data. The network interface may provide remote network access to the unmanned rail vehicle from a remote host, e.g., on operating system level or application level. The data network may be a TCP/IP network such as Internet.

The unmanned rail vehicle 10 is used for performing inspection of a conveyor, e.g., for a conveyor carrying a belt and material on the belt, such as a mining conveyor.

The unmanned rail vehicle 10 is equipped with a sensor for inspection of a conveyor, preferably with at least one of the following: microphone, thermal camera, visual camera.

Being unmanned, the unmanned rail vehicle 10 is not dimensioned, equipped or rated for transport of a human driver or passenger. This allows a small and lightweight construction in accordance with the rail vehicle's purpose of for surveillance, inspection and/or maintenance.

The rail 22 may have at least some of the following parts and properties:

The rail 22 comprises preassigned reference markers 24 at known preassigned positions in the environment or on the rail 22. Further, the preassigned reference markers 24 are interspaced by defined, preassigned spaces 28 along the rail 22.

The rail 22 has embedded preassigned reference markers 24 (e.g. optical, magnetic, tactile) for interaction with a position sensor system installed on the vehicle.

The rail 22 has a generally smooth surface.

The rail 22 has a ribbing or friction-increasing coating to increase traction or prevent slip.

The rail has cut-outs to reduce weight. These cut-outs may also serve as preassigned reference markers 24.

The rail 22 comprises a stopper for bringing the unmanned rail vehicle to a controlled stop on the rail. The unmanned rail vehicle may have a position determining system 16 adapted for calibrating a position of the unmanned rail vehicle 10 when the rail vehicle is engaged with the stopper.

The rail 22 includes individual rail segments.

The rail 22 has straight, horizontally curved, vertically curved, and/or inclined rail segments coupled to each other.

The rail 22 comprises metal or is essentially made of metal (but may additionally comprise a non-metal layer). The The rail 22 comprises steel, preferably stainless steel.

The rail comprises aluminum.

The rail comprises a non-metal (e.g. Nylon, PVC, fiberglass, etc.) or is made of a non-metal.

The rail is made from extruded non-metal/polymer material.

The rail has a hydrophobic coating to avoid dirt and dust accumulation

The rail has corrosion protection (such as paint or galvanized or anodized layer).

The preassigned reference marker 24 may have at least some of the following parts and properties:

The preassigned reference marker 24 is located in the environment of the rail 22, attached to the rail 22 or on the rail 22.

The preassigned reference marker 24 is distinguishable from the rail 22.

The preassigned reference marker 24 is a magnetic marker, an acoustical marker, a vibrational marker and/or an optical marker.

The preassigned reference marker 24 is a hole or cut-out of a generally smooth surface of the rail 22.

The preassigned reference marker 24 has a physical width 26 (i.e. the distance between the beginning and the end of its extension).

The position sensor systems 12, 14 may have at least some of the following parts and properties:

The first and the second position sensor system 12, 14 are both configured for measuring first and second position data, respectively, indicative of a position of the unmanned rail vehicle 10 along the rail 22.

At least one of the first and the second position sensor system 12, 14 is configured for collecting position data based on interaction with at least one preassigned reference marker 24 along the rail structure 20. For example, this position sensor system comprises a preassigned reference marker tracking system for reading preassigned reference markers in the environment or on the rail 22. Preferably, this position sensor system comprises a proximity sensor or switch 30. Also, the position sensor system may comprise a computer vision system, an ultrasonic distance sensor, an optical distance sensor, a laser distance sensor, and a radar sensor.

At least one of the first and the second position sensor system 12, 14 is configured for collecting position data based on detecting a progression of the unmanned rail vehicle along the rail structure 20. For example, this position sensor system comprises a distance measuring system for measuring a progression of the unmanned rail vehicle 10 on the rail 22. For example, the distance measuring system may include at least one of a wheel-based distance measuring system, an aerodynamic distance measuring system, an acceleration sensor system.

Preferably, this position sensor system comprises at least one rotational encoder 40 (such as an incremental or absolute rotational encoder) associated with an encoder wheel 42. The encoder wheel may be configured to roll along the rail structure 20. The rotational encoder 40 may be configured to detect one or more of wheel speed, rotary position, or a combination thereof.

At least one of the first position sensor system 12 and the second position sensor system 14 is configured for collecting position data based on interaction with at least one preassigned reference marker 24 along the rail structure 20 and at least one of the first position sensor system 12 and the second position sensor system 14 is configured for collecting position data based on detecting a progression of the unmanned rail vehicle 10 along the rail structure 20.

The first position sensor system 12 and the second position sensor system 14 is configured for collecting position data based on interaction with at least one preassigned reference marker 24 along the rail structure 20 and at least one of the first position sensor system 12 and the second position sensor system 14 is configured for collecting position data based on detecting a progression of the unmanned rail vehicle 10 along the rail structure 20.

The first sensor system 12 and the second sensor system 14 are rigidly spaced in a fixed mounting distance 18 along a longitudinal axis of the unmanned rail vehicle 10.

The position determining unit 16 may have at least some of the following parts and properties:

The position determining unit 16 is configured for receiving and combining first and second position data of the first position sensor system 12 and the second position sensor system 14, respectively, to determine the position of the unmanned rail vehicle 10 along the rail 22.

The position determining unit 16 is configured for to combine the position data received from the position sensor systems by i) setting the position data of the unmanned rail vehicle 10 to a known position detected by at least the first or second position sensor system 12, 14 configured for collecting position data based on interaction with one or more preassigned reference marker 24 along the rail structure 20, and ii) computing one or more intermediate position of the unmanned rail vehicle 10 on the rail structure 20 based on one or more progression data inputs 46 received from at least the first or second position sensor system 12, 14 configured for collecting position data based on detecting a progression of the unmanned rail vehicle along the rail structure. Preferably, if a known position of the one or more preassigned reference 24 marker is detected at a computed intermediate position of the unmanned rail vehicle 10, the position data of the unmanned rail vehicle 10 is set to the position of the one or more preassigned reference marker 24.

The position determining unit 16 is configured to receive more than one progression data inputs 46 from the first or second position sensor system 12, 14 configured for collecting position data based on detecting a progression of the unmanned rail vehicle along the rail structure, and wherein in case of a disparity between the more than one progression data inputs 46, the maximum absolute value of progression is selected.

The position determining unit 16 is configured to determine a discrepancy of the output values between the two or more position determining units, and to diagnose a malfunction in one of the position determining units in case of the determined discrepancy exceeding a predetermined threshold.

While the above describes some examples of the invention, these examples are not to be considered as limiting the scope of the invention, which is defined by the following claims.

The invention claimed is:

1. An unmanned rail vehicle for surveillance, inspection and/or maintenance of an infrastructure, the infrastructure comprising a rail structure with a rail, the unmanned rail vehicle being movable along the rail and the unmanned rail vehicle comprising:

a first position sensor system configured for measuring, by interaction with the rail structure, first position data indicative of a position of the unmanned rail vehicle along the rail, wherein the first position sensor system is configured for collecting position data based on interaction with at least one preassigned reference marker along the rail structure, wherein the first position sensor system includes at least one proximity sensor or switch, wherein the at least one proximity sensor or switch is mounted on the unmanned rail vehicle and configured for collecting proximity data with respect to a surface of the rail, a second position sensor system configured for measuring, by interaction with the rail structure, second position data indicative of a position of the unmanned rail vehicle along the rail, wherein the second position sensor system includes at least one rotational encoder associated with an encoder wheel configured to roll along the rail structure, wherein each of the at least one rotational encoder is configured to detect one or more of wheel speed, rotary position, or a combination thereof, and a position determining unit configured for receiving and combining first and second position data to determine the position of the unmanned rail vehicle along the rail, wherein the position determining unit is configured to receive more than one progression data inputs from the first or second position sensor system configured for collecting position data based on detecting a progression of the unmanned rail vehicle along the rail structure, and wherein in case of a disparity between the more than one progression data inputs, the maximum absolute value of progression is selected.

2. The unmanned rail vehicle according to claim 1, wherein at least one of the first position sensor system and the second position sensor system is configured for collecting position data based on interaction with at least one preassigned reference marker along the rail structure and wherein at least one of the first position sensor system and the second position sensor system is configured for collecting position data based on detecting a progression of the unmanned rail vehicle along the rail structure.

3. The unmanned rail vehicle according to claim 1, wherein the preassigned reference marker is selected from an inductive marker, an optical marker, an ultrasonic marker, holes or cut-outs in the rail structure, or a combination thereof.

4. The unmanned rail vehicle according to claim 1, wherein the first position sensor system and/or the second position sensor system is configured for collecting position data based detecting a progression of the unmanned rail vehicle along the rail structure.

5. The unmanned rail vehicle according to claim 1, wherein the first position sensor system and the second position sensor system is configured for collecting position data based on interaction with at least one preassigned reference marker along the rail structure and wherein at least one of the first position sensor system and the second position sensor system is configured for collecting position data based on detecting a progression of the unmanned rail vehicle along the rail structure.

6. The unmanned rail vehicle according to claim 1, wherein the second position sensor system is arranged in a defined mounting distance with respect to the first position sensor system along a longitudinal axis of the unmanned rail vehicle.

7. The unmanned rail vehicle according to claim 1, wherein the position determining unit is configured to combine the received position data by i) setting the position data of the unmanned rail vehicle to a known position detected by at least the first or second position sensor system configured for collecting position data based on interaction with one or more preassigned reference marker along the rail structure, and ii) computing one or more intermediate position of the unmanned rail vehicle on the rail structure based on one or more progression data inputs received from at least the first or second position sensor system configured for collecting position data based on detecting a progression of the unmanned rail vehicle along the rail structure.

8. The unmanned rail vehicle according to claim 7, wherein if a known position of the one or more preassigned reference marker is detected at a computed intermediate position of the unmanned rail vehicle, the position data of the unmanned rail vehicle is set to the position of the one or more preassigned reference marker.

9. The unmanned rail vehicle according to claim 1, comprising at least one position sensor system configured for detecting signal changes based on interaction with a preassigned reference marker along the rail structure, at least one position sensor system configured for detecting a progression of the unmanned rail vehicle along the rail structure, and a position determining unit configured for i) Registering a first position p(t1) of the unmanned rail vehicle when detecting a first signal change by the at least one position sensor system configured for detecting signal changes based on interaction with a preassigned reference marker along the rail structure ii) Calculating a travel distance LM(=p(t)−p(t1)=v(t)*dt) of the unmanned rail vehicle between the first signal change and at least a second signal change detected by the at least one position sensor system configured for detecting signal changes based on interaction with a preassigned reference marker along the rail structure on the basis of the progression data detected by the at least one position sensor system configured for detecting a progression of the unmanned rail vehicle along the rail structure iii) Concluding that a preassigned reference marker was identified if the calculated travel distance LM is within a preassigned range of a respective physical width of the preassigned reference marker on the rail structure, or rejecting the conclusion if not.

10. The unmanned rail vehicle according to claim 1, comprising at least one position sensor system configured for detecting signal changes based on interaction with a preassigned reference marker along the rail structure, at least one position sensor system configured for detecting a progression of the unmanned rail vehicle along the rail structure, and a position determining unit configured for i) Registering a first position p(t1) of the unmanned rail vehicle when detecting a first signal change by the at least one position sensor system configured for detecting signal changes based on interaction with a preassigned reference marker along the rail structure ii) Calculating a travel distance LM(=p(t)−p(t1)=v(t)*dt) of the unmanned rail vehicle between the first signal change and at least a second signal change detected by the at least one position sensor system configured for detecting signal changes based on interaction with a preassigned reference marker along the rail structure on the basis of the progression data detected by the at least one position sensor system configured for detecting a progression of the unmanned rail vehicle along the rail structure iii) Concluding that a preassigned reference marker was identified if the calculated travel distance LM is within a preassigned range of a respective preassigned space between two preassigned reference markers along the rail structure, or rejecting the conclusion if not.

11. The unmanned rail vehicle according to claim 1, wherein the first position sensor system and the second position sensor system is configured for collecting position data based on interaction with a preassigned reference marker along the rail structure and wherein at least one of the first position sensor system and the second position sensor system is configured for collecting position data based on detecting a progression of the unmanned rail vehicle along the rail structure, and wherein the position determining unit is configured for i) Registering a first position p1 of the unmanned rail vehicle when detecting a signal change by the first position sensor system based on interaction with a preassigned reference marker along the rail structure ii) Registering a second position p2 of the unmanned rail vehicle when detecting a signal change by the second position sensor system based on interaction with the preassigned reference marker along the rail structure iii) Calculating a travel distance dp of the unmanned rail vehicle between the signal change detected the first position sensor system and the signal change detected by the second position sensor system based on interaction with the preassigned reference marker on the basis of the progression data detected by the at least one position sensor system configured for detecting a progression of the unmanned rail vehicle along the rail structure iv) Concluding that a preassigned reference marker was identified if the calculated travel distance dp is within a preassigned range of a the preassigned mounting distance between the first position sensor system and the second position sensor system, or rejecting the conclusion if not.

12. The unmanned rail vehicle according to claim 1, wherein the position determining unit is further configured to compute output signals influencing the traction and motion of the unmanned rail vehicle along the rail structure and to send output signals to a traction motor control of the unmanned rail vehicle.

13. The unmanned rail vehicle according to claim 1, further comprising at least a second position determining unit configured for receiving and combining first and second position data to determine the position of the unmanned rail vehicle along the rail.

14. The unmanned rail vehicle according to claim 1, wherein the unmanned rail vehicle is a robot with structure that is dimensioned or rated for transport without a driver.

15. The unmanned rail vehicle according to claim 1, wherein the preassigned reference marker is a predefined shape feature of the rail.

16. An infrastructure comprising:

an unmanned rail vehicle including:

a first position sensor system configured for measuring, by interaction with the rail structure, first position data indicative of a position of the unmanned rail vehicle along the rail, wherein the first position sensor system is configured for collecting position data based on interaction with at least one preassigned reference marker along the rail structure, wherein the first position sensor system includes at least one proximity sensor or switch, wherein the at least one proximity sensor or switch is mounted on the unmanned rail vehicle and configured for collecting proximity data with respect to a surface of the rail, a second position sensor system configured for measuring, by interaction with the rail structure, second position data indicative of a position of the unmanned rail vehicle along the rail, wherein the second position sensor system includes at least one rotational encoder associated with an encoder wheel configured to roll along the rail structure, wherein each of the at least one rotational encoder is configured to detect one or more of wheel speed, rotary position, or a combination thereof, and a position determining unit configured for receiving and combining first and second position data to determine the position of the unmanned rail vehicle along the rail, wherein the position determining unit is configured to receive more than one progression data inputs from the first or second position sensor system configured for collecting position data based on detecting a progression of the unmanned rail vehicle along the rail structure, and wherein in case of a disparity between the more than one progression data inputs, the maximum absolute value of progression is selected, and a rail structure with a rail.

17. The infrastructure according to claim 16, wherein the infrastructure comprises a conveyor, and wherein the unmanned rail vehicle is movable along the conveyor and configured for surveillance, inspection and/or maintenance of the conveyor.

18. A method of determining a position of an unmanned rail vehicle on a rail structure, comprising providing the unmanned rail vehicle including:

a first position sensor system configured for measuring, by interaction with the rail structure, first position data indicative of a position of the unmanned rail vehicle along the rail, wherein the first position sensor system is configured for collecting position data based on interaction with at least one preassigned reference marker along the rail structure, wherein the first position sensor system includes at least one proximity sensor or switch, wherein the at least one proximity sensor or switch is mounted on the unmanned rail vehicle and configured for collecting proximity data with respect to a surface of the rail, a second position sensor system configured for measuring, by interaction with the rail structure, second position data indicative of a position of the unmanned rail vehicle along the rail, wherein the second position sensor system includes at least one rotational encoder associated with an encoder wheel configured to roll along the rail structure, wherein each of the at least one rotational encoder is configured to detect one or more of wheel speed, rotary position, or a combination thereof; and a position determining unit configured for receiving and combining first and second position data to determine the position of the unmanned rail vehicle along the rail, wherein the position determining unit is configured to receive more than one progression data inputs from the first or second position sensor system configured for colleting position data based on detecting a progression of the unmanned rail vehicle along the rail structure, and wherein in case of a disparity between the more than one progression data inputs, the maximum absolute value of progression is selected, i) Periodically measuring the progression of the unmanned rail vehicle along the rail structure by means of the at least a first position sensor system of the unmanned rail vehicle, ii) Collecting position data based on interaction with the one or more preassigned reference marker along the rail structure by means of at least the second position sensor system of the unmanned rail vehicle, iii) Receiving and combining the progression data of step i) and the position data of step ii) to periodically calculate the position of the unmanned rail vehicle on the rail structure by means of the position determining unit.

19. A method of determining a position of an unmanned rail vehicle on a rail structure, the unmanned rail vehicle including:

a first position sensor system configured for measuring, by interaction with the rail structure, first position data indicative of a position of the unmanned rail vehicle along the rail, wherein the first position sensor system is configured for collecting position data based on interaction with at least one preassigned reference marker along the rail structure, wherein the first position sensor system includes at least one proximity sensor or switch, wherein the at least one proximity sensor or switch is mounted on the unmanned rail vehicle and configured for collecting proximity data with respect to a surface of the rail, a second position sensor system configured for measuring, by interaction with the rail structure, second position data indicative of a position of the unmanned rail vehicle along the rail, wherein the second position sensor system includes at least one rotational encoder associated with an encoder wheel configured to roll along the rail structure, wherein each of the at least one rotational encoder is configured to detect one or more of wheel speed, rotary position, or a combination thereof, and a position determining unit configured for receiving and combining first and second position data to determine the position of the unmanned rail vehicle along the rail, wherein the position determining unit is configured to receive more than one one progression data inputs from the first or second position sensor system configured for colleting position data based on detecting a progression of the unmanned rail vehicle along the rail structure, and wherein in case of a disparity between the more than one progression data inputs, the maximum absolute value of progression is selected, the method comprising:

i) setting the position data of the unmanned rail vehicle to a known position detected based on interaction with the one or more preassigned reference marker along the rail structure, ii) computing one or more intermediate position of the unmanned rail vehicle on the rail structure based on one or more progression data inputs received for the unmanned rail vehicle.

20. A method of identifying a preassigned reference marker along a rail structure using an unmanned rail vehicle, which includes:

a first position sensor system configured for measuring, by interaction with the rail structure, first position data indicative of a position of the unmanned rail vehicle along the rail, wherein the first position sensor system is configured for collecting position data based on interaction with at least one preassigned reference marker along the rail structure, wherein the first position sensor system includes at least one proximity sensor or switch, a second position sensor system configured for measuring, by interaction with the rail structure, second position data indicative of a position of the unmanned rail vehicle along the rail, wherein the second position sensor system includes at least one rotational encoder associated with an encoder wheel configured to roll along the rail structure, wherein each of the at least one rotational encoder is configured to detect one or more of wheel speed, rotary position, or a combination thereof, and a position determining unit configured for receiving and combining first and second position data to determine the position of the unmanned rail vehicle along the rail, the method comprising:

using the first position sensor system configured for detecting signal changes based on interaction with the preassigned reference marker along the rail structure, the second position sensor system configured for detecting a progression along the rail structure, and the position determining unit, i) Registering a first position p(t1) when detecting a first signal change by the first position sensor system configured for detecting signal changes based on interaction with a preassigned reference marker along the rail structure, ii) Calculating a travel distance LM(=p(t)−p(t1)=v(t)*dt) between the first signal change and at least a second signal change detected by the first position sensor system configured for detecting signal changes based on interaction with a preassigned reference marker along the rail structure on the basis of the progression data detected by the second position sensor system configured for detecting a progression along the rail structure, iii) Concluding that a preassigned reference marker was identified if the calculated travel distance LM is within a preassigned range of a respective physical width of the preassigned reference marker on the rail structure, or rejecting the conclusion if not.

21. A method of identifying a preassigned reference marker along a rail structure using an unmanned rail vehicle including:

a first position sensor system configured for measuring, by interaction with the rail structure, first position data indicative of a position of the unmanned rail vehicle along the rail, wherein the first position sensor system is configured for collecting position data based on interaction with at least one preassigned reference marker along the rail structure, wherein the first position sensor system includes at least one proximity sensor or switch, a second position sensor system configured for measuring, by interaction with the rail structure, second position data indicative of a position of the unmanned rail vehicle along the rail, wherein the second position sensor system includes at least one rotational encoder associated with an encoder wheel configured to roll along the rail structure, wherein each of the at least one rotational encoder is configured to detect one or more of wheel speed, rotary position, or a combination thereof, and a position determining unit configured for receiving and combining first and second position data to determine the position of the unmanned rail vehicle along the rail, the method comprising:

using the first position sensor system configured for detecting signal changes based on interaction with the preassigned reference marker along the rail structure, the second position sensor system configured for detecting a progression along the rail structure, and the position determining unit, i) Registering a first position p(t1) when detecting a first signal change by the first position sensor system configured for detecting signal changes based on interaction with a preassigned reference marker along the rail structure, ii) Calculating a travel distance LM(=p(t)−p(t1)=v(t)*dt) between the first signal change and at least a second signal change detected by the first position sensor system configured for detecting signal changes based on interaction with a preassigned reference marker along the rail structure on the basis of the progression data detected by the second position sensor system configured for detecting a progression along the rail structure, iii) Concluding that a preassigned reference marker was identified if the calculated travel distance LM is within a preassigned range of a respective preassigned space between two preassigned reference markers along the rail structure, or rejecting the conclusion if not.

22. A method of identifying a preassigned reference marker along a rail structure using an unmanned rail vehicle including:

a first position sensor system configured for measuring, by interaction with the rail structure, first position data indicative of a position of the unmanned rail vehicle along the rail, wherein the first position sensor system is configured for collecting position data based on interaction with at least one preassigned reference marker along the rail structure, wherein the first position sensor system includes at least one proximity sensor or switch, a second position sensor system configured for measuring, by interaction with the rail structure, second position data indicative of a position of the unmanned rail vehicle along the rail, wherein the second position sensor system includes at least one rotational encoder associated with an encoder wheel configured to roll along the rail structure, wherein each of the at least one rotational encoder is configured to detect one or more of wheel speed, rotary position, or a combination thereof, and a position determining unit configured for receiving and combining first and second position data to determine the position of the unmanned rail vehicle along the rail, the method comprising:

using the first position sensor system configured for detecting signal changes based on interaction with the preassigned reference marker along the rail structure, the first and second position sensor system being mounted at a preassigned mounting distance to each other, wherein the second position sensor system is configured for collecting position data based on detecting a progression of the unmanned rail vehicle along the rail structure, and a position determining unit, i) Registering a first position p1 when detecting a signal change by the first position sensor system based on interaction with the preassigned reference marker along the rail structure, ii) Registering a second position p2 when detecting a signal change by the second position sensor system based on interaction with the preassigned reference marker along the rail structure, iii) Calculating a travel distance dp between the signal change detected the first position sensor system and the signal change detected by the second position sensor system based on interaction with the preassigned reference marker on the basis of the progression data detected by the at least one position sensor system configured for detecting a progression of the unmanned rail vehicle along the rail structure, iv) Concluding that a preassigned reference marker was identified if the calculated travel distance dp is within a preassigned range of the preassigned mounting distance between the first position sensor system and the second position sensor system, or rejecting the conclusion if not.

* * * * *